US005758362A

United States Patent [19]

Focke et al.

[11] Patent Number: 5,758,362

[45] Date of Patent: Jun. 2, 1998

[54] PROCESS AND DEVICE FOR HANDLING STACKS OF BLANKS HAVING WRAPPINGS

[75] Inventors: Heinz Focke, Verden; Hugo Mutschall, Kirchlinteln; Frank Hill, Bremen, all of Germany

[73] Assignee: Focke & Co., (GmbH & Co), Verden, Germany

[21] Appl. No.: 540,486

[22] Filed: Oct. 10, 1995

[30] Foreign Application Priority Data

Oct. 11, 1994 [DE] Germany ..... 44 36 330.3

[51] Int. Cl.[6] ..... B65B 43/26

[52] U.S. Cl. ..... 53/492; 53/382.1; 53/386.1; 414/412; 83/100

[58] Field of Search ..... 53/381.2, 386.1, 53/492; 83/100, 152, 175, 176, 935; 414/412

[56] References Cited

U.S. PATENT DOCUMENTS

| | | | |
|---|---|---|---|
| 4,328,609 | 5/1982 | Born | 83/100 |
| 4,390,313 | 6/1983 | Hoehn | 53/381.2 |
| 4,718,157 | 1/1988 | Keyzers et al. . | |
| 4,995,784 | 2/1991 | Boisseau . | |
| 5,101,793 | 4/1992 | Tanaka et al. | 83/176 |
| 5,282,346 | 2/1994 | Masuda et al. | 53/492 |
| 5,304,030 | 4/1994 | Meri | 414/412 |
| 5,318,399 | 6/1994 | Marom | 414/412 |
| 5,371,938 | 12/1994 | Martin | 414/412 |
| 5,419,095 | 5/1995 | Yohe | 414/412 |
| 5,489,028 | 2/1996 | Binder | 414/412 |

FOREIGN PATENT DOCUMENTS

| | | |
|---|---|---|
| 100990 | 2/1984 | European Pat. Off. . |
| 146391 | 6/1985 | European Pat. Off. . |
| 251414 | 1/1988 | European Pat. Off. . |
| 607626 | 7/1994 | European Pat. Off. . |
| 3443362 | 6/1989 | Germany . |
| 4010340 | 10/1990 | Germany . |
| 69000287 | 1/1993 | Germany . |
| 4301169 | 7/1994 | Germany . |

OTHER PUBLICATIONS

Patent Abstracts of Japan, unexamined applications, Sektion M. Ban 18, Nr. 37, Jan. 20, 1994 The Patent Office Japanese Government, pp. 47 M 1545 & JP–A–05 269 693.

*Primary Examiner*—John Sipos
*Assistant Examiner*—Gene L. Kim
*Attorney, Agent, or Firm*—Sughue, Mion, Zinn, Macpeak & Seas

[57] ABSTRACT

A process and a device for severing wrappings (11) in each case surrounding a stack (10) of blanks and for removing the wrappings (11).

To guarantee that they are held together better, stacks (10) of blanks are surrounded by a strip-shaped wrapping (11). In the region of a wrappings station (19), these are severed by a horizontally movable knife (23). The knife (23) enters into the upper area of an upright limb (12) of the wrapping (11), between upper blanks of the stack (10) of blanks, and is moved along a guide rail (25) whilst severing the wrapping (11). The latter is subsequently drawn away downward by a drawing force.

17 Claims, 8 Drawing Sheets

PROCESS AND DEVICE FOR HANDLING STACKS OF BLANKS HAVING WRAPPINGS

BACKGROUND OF THE INVENTION

The invention relates to a process for transporting stacks of blanks, which are surrounded by a strip-shaped wrapping, in conjunction with a packaging machine, in particular to a blanks magazine of the packaging machine, the wrapping being Severed and removed in the area of a wrappings station. The invention furthermore relates to a device for carrying out the process.

Blanks for the production of packages from (thin) card, in particular for the production of hinge-lid boxes for cigarettes, are normally prefabricated in a carton-board factory and supplied as stacks of blanks. In order to ensure the formation of the stacks of blanks, it is widely customary to provide the stacks of blanks with a strip-shaped wrapping made of paper, film or the like, surrounding the said stack. In the area of the packaging machine, the wrapping must then be severed and removed, so that wrapping-free stacks of blanks can be transferred to the packaging machine, in particular a blanks magazine of the same.

SUMMARY OF THE INVENTION

The invention is concerned with the handling of stacks of blanks surrounded by wrappings in the area of a packaging machine. The invention is based on the object of improving the severing and removal of the wrappings, in particular to accelerate it, without the risk of damaging blanks arising.

To achieve this object, the process according to the invention is defined in that the knife is inserted in the upper area of an upright limb of the wrapping between upper blanks of the stack of blanks and the wrapping is severed directly below an upper transverse web by means of relative movement of the knife and stack of blanks along the upright limb.

A further important feature of the invention consists in the removal of the severed wrapping. According to the invention, this is drawn away downward, specifically in such a manner that, after the severing of the upright limb, the latter is firstly moved downward by an upright hearing wall which can be moved up and down and then, after the pushing away of the stack of blanks, the wrapping as a whole is drawn away downward by corresponding conveying elements.

After the severing of the wrapping, according to the invention the stack of blanks is pushed away from the wrappings station by a special pusher unit onto a discharge conveyor which feeds the stack of blanks, free of wrapping, to the packaging machine. The discharge conveyor is preferably a vertical conveyor having a platform for the accommodation of each stack of blanks.

Further features of the invention relate to details of the wrappings station, to the elements for drawing off and removing the severed wrapping, to the cutting unit and to the conveying element for transporting the stack of blanks away.

BRIEF DESCRIPTION OF THE DRAWINGS

Further details of the invention are explained in more detail below with reference to an exemplary embodiment of the device according to the invention shown in the drawings, in which.

DESCRIPTION OF PREFERRED EMBODIMENTS

Figure 1:
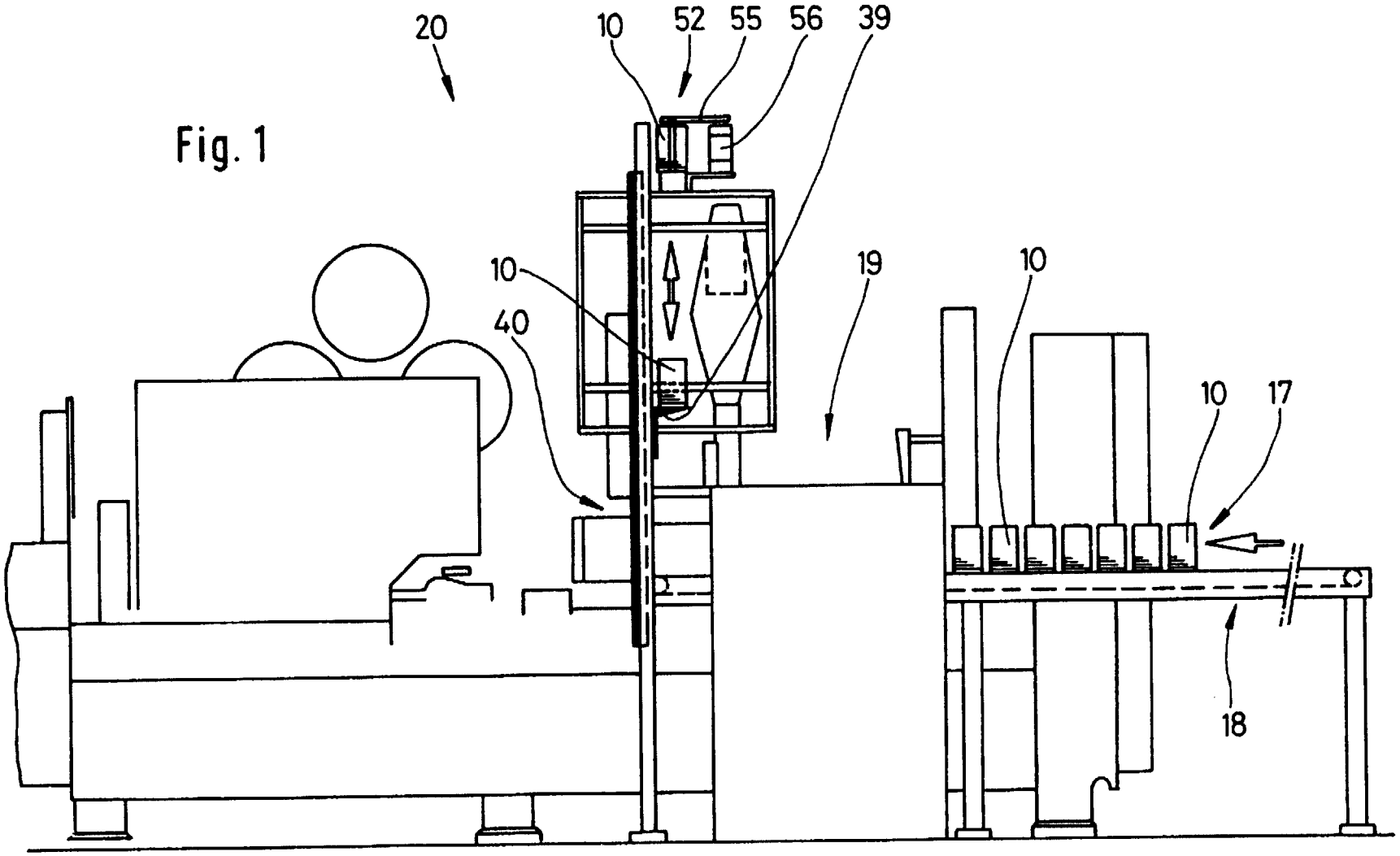
FIG. 1 shows a packaging machine in a schematic representation having a wrappings station, in rear view.
Figure 2:
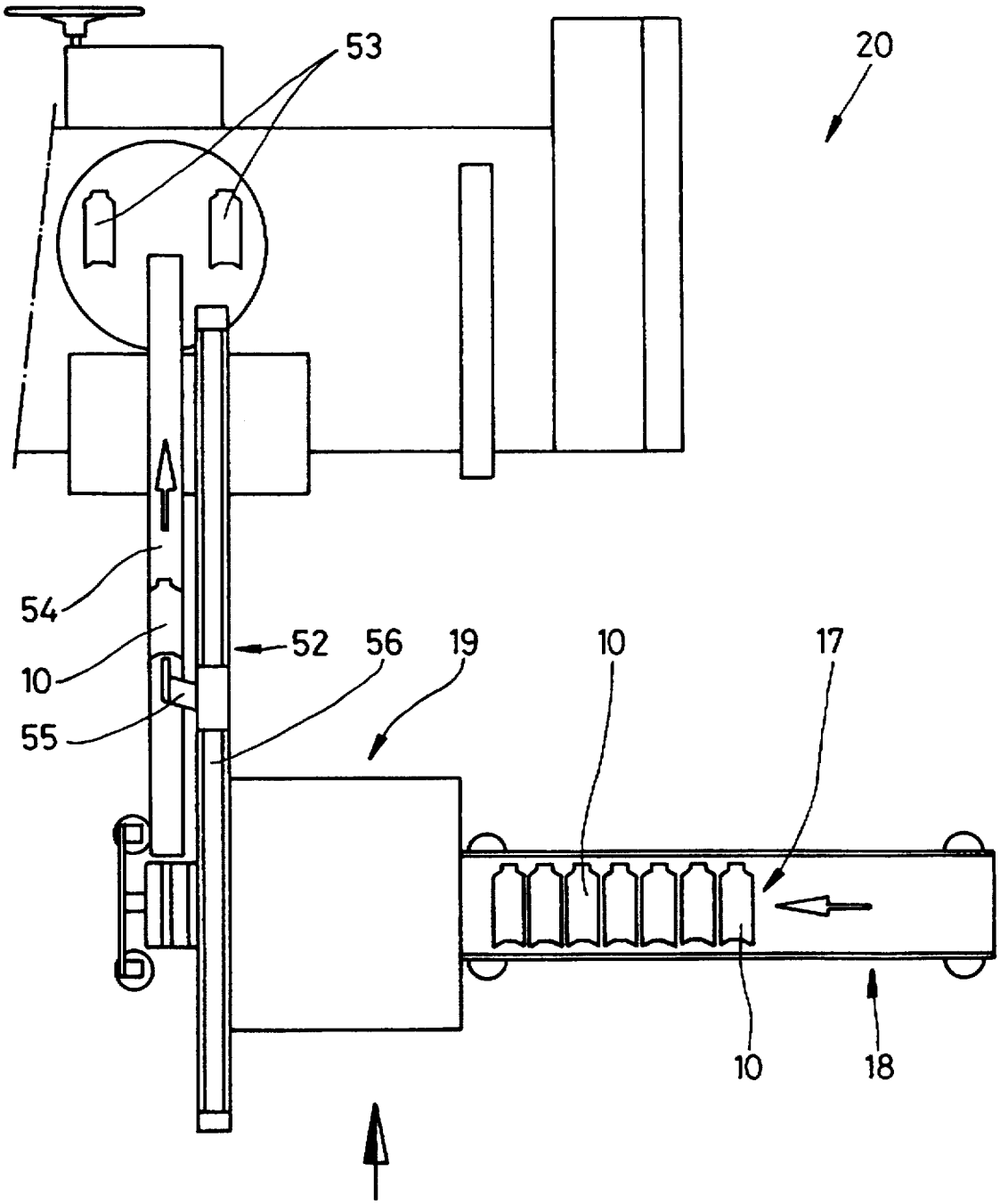
FIG. 2 shows the wrappings station of the packaging machine according to FIG. 1 in a schematic plan view.

The exemplary embodiments of the drawings concern the handling of stacks 10 of blanks made up of blanks for the cigarette industry. It concerns elongated blanks with the contour which is characteristic for the production of hinge-lid boxes. The blanks consist of thin card.

Each stack of blanks 10 is surrounded by a strip-shaped wrapping 11. The latter is designed as an endless, rectangular tube piece having mutually opposite upright limbs 12, 13 and upper and lower transverse webs 14, 15. The wrapping 11 is formed from an endless material strip with an adhesively bonded overlap 16 in the area of the limb 13. The wrapping 11 preferably consists of paper (kraft paper), but can also consist of a film or another suitable material. It is advantageous if the wrapping 11 is designed to be largely airtight by means of coating or other measures.

The stacks 10 of blanks, provided with such a wrapping 11, are delivered, for example, on a pallet (not shown). A suitable lifting conveyor, for example a robot having a lifting head, deposits the stacks 10 of blanks individually or in groups on a feed conveyor 18, forming a continuous row 17. Said feed conveyor is designed as a belt conveyor.

The feed conveyor 18 can be driven cyclically. It transports the stacks 10 of blanks one after another into a wrappings station 19. In the area of the latter, the wrapping 11 is severed and removed. The stacks 10 of blanks freed from the wrapping 11 are transferred to a discharge conveyor which feeds the stacks 10 of blanks to further processing. In the present case, the wrappings station 19 is part of a packaging machine 20 for the production of hinge-lid boxes for cigarettes. Feed conveyor 18 and wrappings station 19 are positioned in the area of the rear of the packaging machine 20.

In the wrappings station 19, the stack 10 of blanks is conveyed by the feed conveyor 18 onto a support, namely onto a plate 21. On the latter, the stack 10 of blanks rests during the severing of the wrapping 11.

Above the plate 21 and the stack 10 of blanks, there is positioned a cutting unit 22 which can be moved up and down. This is equipped with a cutting blade located horizontally or a knife 23 for severing the wrapping 11. For this purpose, the blade-like knife 23 is moved in the horizontal plane relative to the stack 10 of blanks or to the wrapping 11.

The knife 23 is fitted to a knife-holder 24 which can be moved to and fro and which can be displaced like a slide on a guide rail 25 of the cutting unit 22. The elongated knife 23 or a cutting edge 26 of the same is aligned at an acute angle to the direction of movement during the cutting process, that is to say to the guide rail 25.

To carry out a cutting process, the cutting unit 22 is lowered by a lifting cylinder 27 onto the cutting plane. The knife 23 then lieu in a plane directly underneath the upper, transversely-directed limb 12 of the wrapping 11 in such a manner that the knife 23 moves between upper blanks of the stack 10 of blanks and also enters with part of its area between the blanks. In this case a few or only one blank lies above the severing plane of the knife 23.

To carry out the severing cut, the knife holder 24 is displaced along the guide rail 25. During this, the knife 23 is firstly guided outside the area of the wrapping 11 between upper blanks, until the upright limb 12 is seized and severed. During the cutting movement, the knife 23 slides as far as to the end of the stack of blanks.

As a result of the position of the cutting plane in the area of the limb 12, after completing the severing cut a residual web 28 of the limb 12 is produced, which remains connected to the transverse web 14. In order that this hook-shaped structure is removed reliably, the cutting unit 22 is provided with an auxiliary device. On that side of the stack 10 of blanks which is opposite the knife 23, pressure is exerted from above by means of an elongated, strip-shaped plunger plate 29. This is lowered, with the cutting unit 22, from above onto the stack 10 of blanks and in loaded by the lifting cylinder 27. Together with the cutting unit 22, furthermore, a sucking element or a sucker 30 is lowered from above onto the stack 10 of blanks. The sucker 30 is effective in an area of the transverse web 14 facing the knife 23. After carrying out the severing cut, the transverse web 14 is lifted by the sucker 30, carrying along the residual web 28, so that the residual web 28 comes free from the stack 10 of blanks.

The plunger plate 29, which preferably lies over the entire length of the stack 10 of blanks on the latter and off-center, has the additional effect that in particular the upper blanks on that side facing the knife 23 are easily fanned out. As a result, the introduction of the knife 23 into the area between the upper blanks is facilitated.

Figure 4:
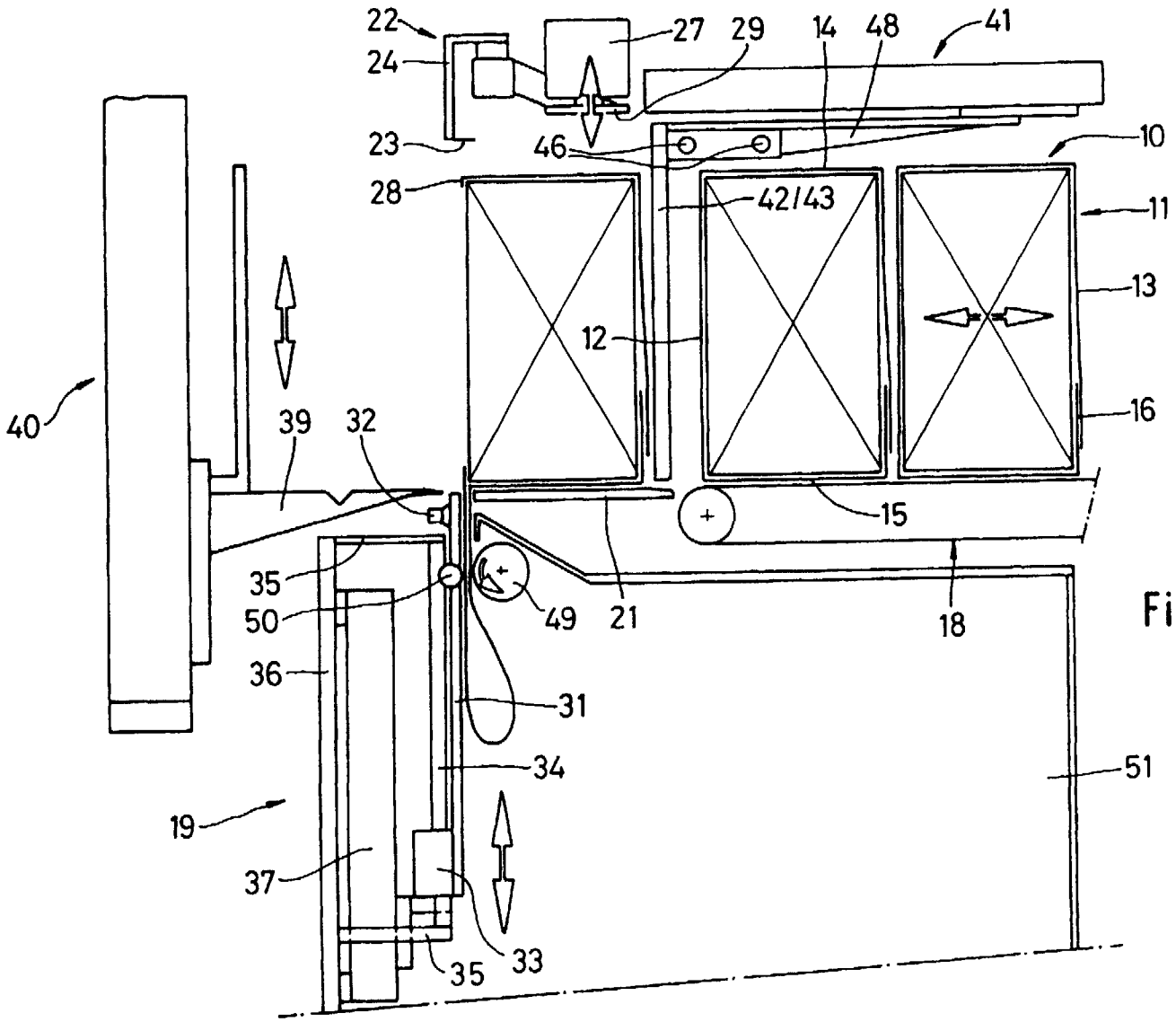
FIG. 4 shows a representation similar to FIG. 3 with a changed position of elements.

After carrying out a severing cut, the knife 23 with the knife-holder 24 is moved back into the initial position and the cutting unit 22 is moved into the upper initial position according to FIG. 4.

The severed wrapping 11 is subsequently removed. For this purpose, the wrapping 11 is seized by a holder in the area of the limb 12. Said holder comprises, in the present case, a bearing wall 31 which simultaneously serves in the initial position for the exact positioning of the stack 10 of blanks on the plate 21. The stack 10 of blanks rests with the limb 12 of the wrapping 11 on the bearing wall 31 (FIG. 3).

The bearing wall 31 is provided with holding elements for seizing the wrapping 11 after the severing. These are several sucking elements 32 arranged aide by side. These are positioned on the bearing wall 31 in such a way that they seize the severed limb 12 in the upper area.

The bearing wall 31 can be moved up and down in the vertical plane. For this purpose, the bearing wall 31 is supported using sliding guides 33 on two upright guide rods 34 which are arranged at a distance from each other. Said guide rods are in turn fitted at the top and bottom with transverse webs 35 to a stationary upright supporting wall 36. Also fastened to the latter is a cylinder without a piston rod, namely an upright linear cylinder 37. A piston, which can be moved up and down, of the latter is connected to the sliding guides 33. By means of the linear cylinder 37, accordingly, the bearing wall 31 can be moved up and down.

Figure 3:
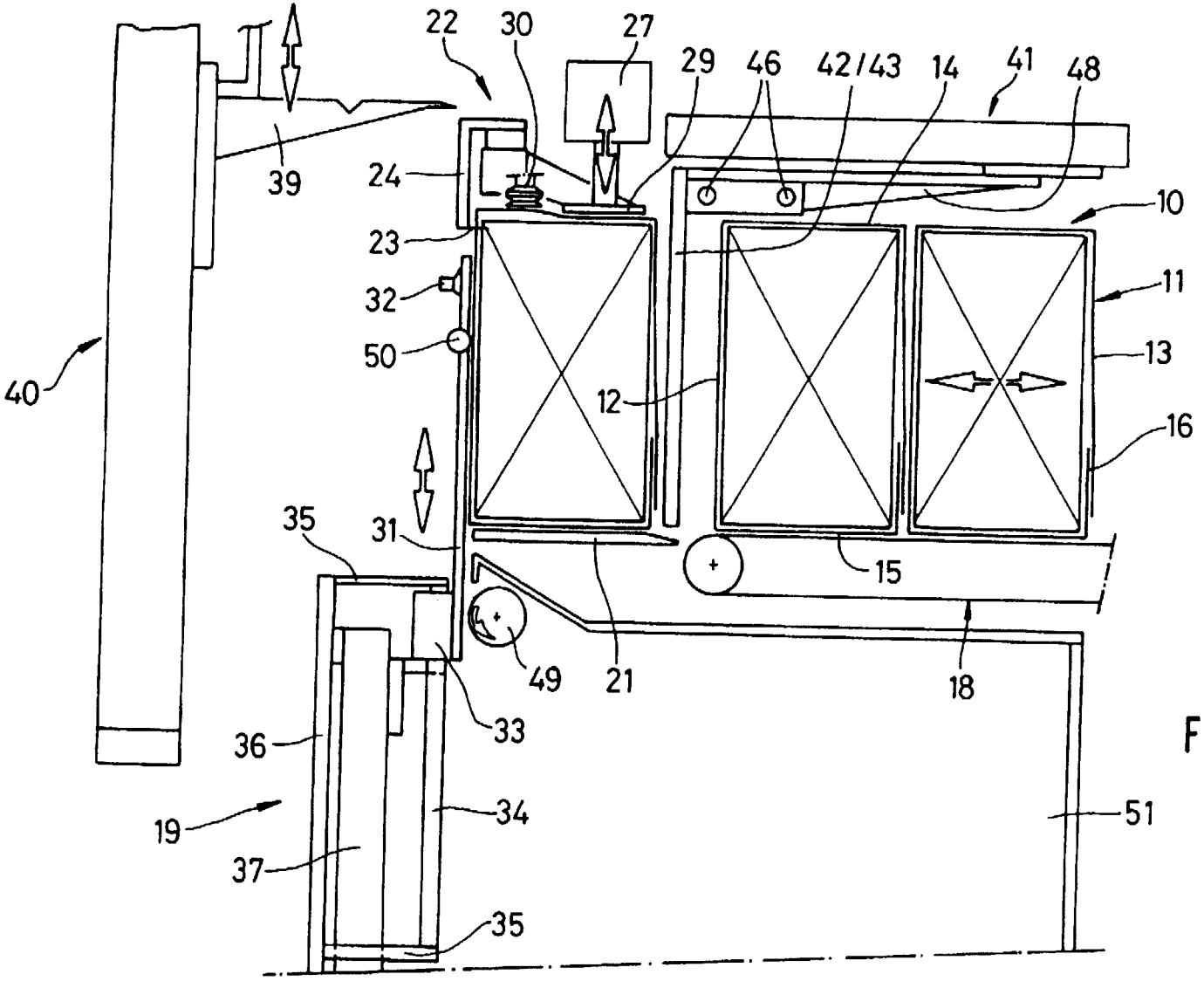
FIG. 3 shows the wrappings station as a detail in side view, on an enlarged scale.
Figure 5:
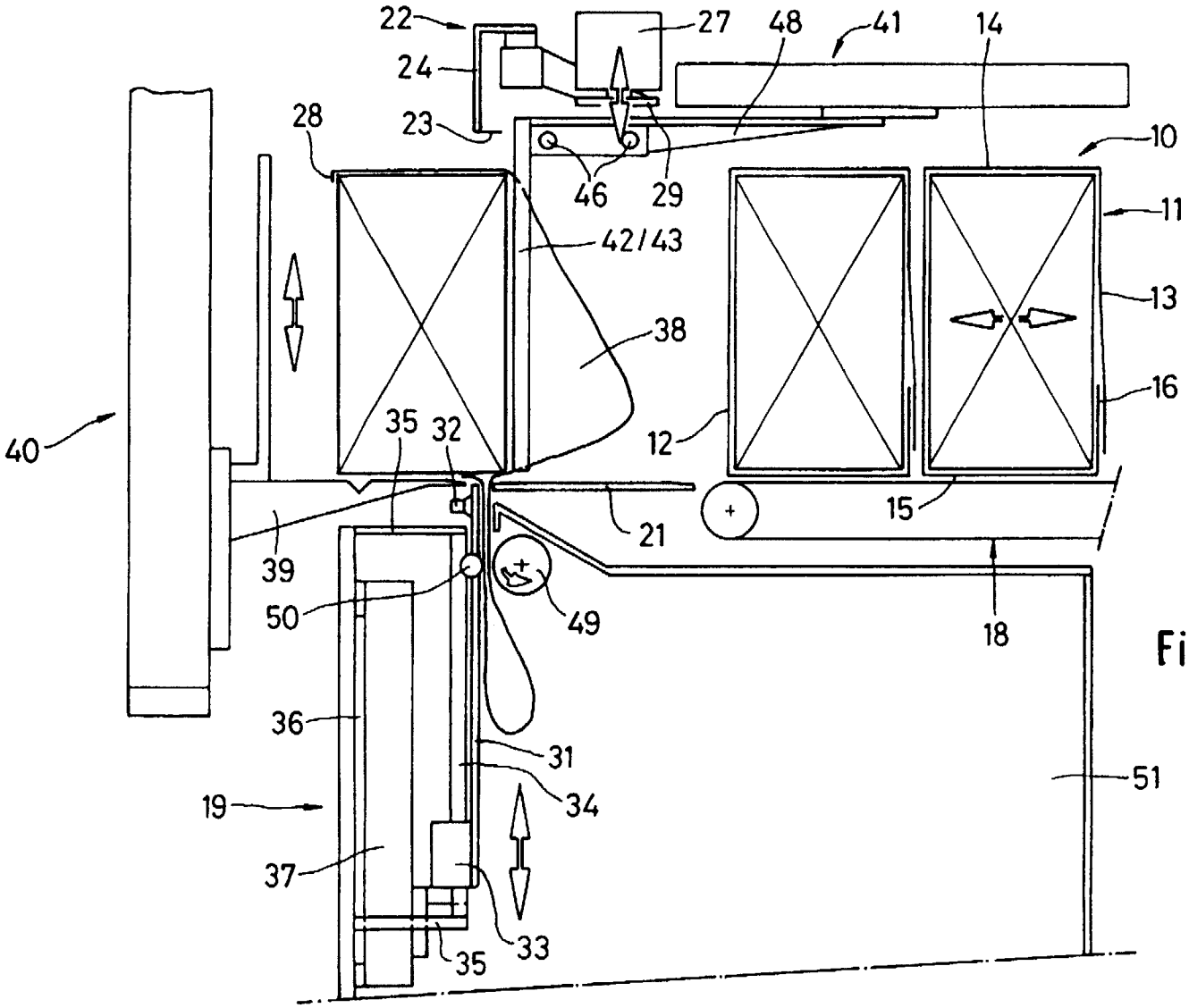
FIG. 5 shows a further representation corresponding to FIG. 3 and FIG. 4 during a phase of the removal of a severed wrapping.

By moving the bearing wall 31 downward out of the upper position according to FIG. 3 into the lower position according to FIG. 4 and FIG. 5, the limb 12 of the wrapping 11, held by the sucking elements 32, is concomitantly moved downward. Since the stack 10 of blanks rests unchanged on the remaining part of the wrapping 11, namely on the lower transverse web 15, the limb 12 initially forms a loop (FIG. 4).

The stack 10 of blanks is now moved out of the wrappings station 19, the severed wrapping 11 being held back or conveyed away. The stack 10 of blanks passes without the wrapping 11 onto a discharge conveyor. In the present case, the stack 10 of blanks is pushed out directly from the plate 21 onto a platform 39 of a vertical conveyor 40. The platform, supported on one side on this vertical conveyor 40, extends at the height of the plate 21 during the acceptance of the stack 10 of blanks.

Figure 8:
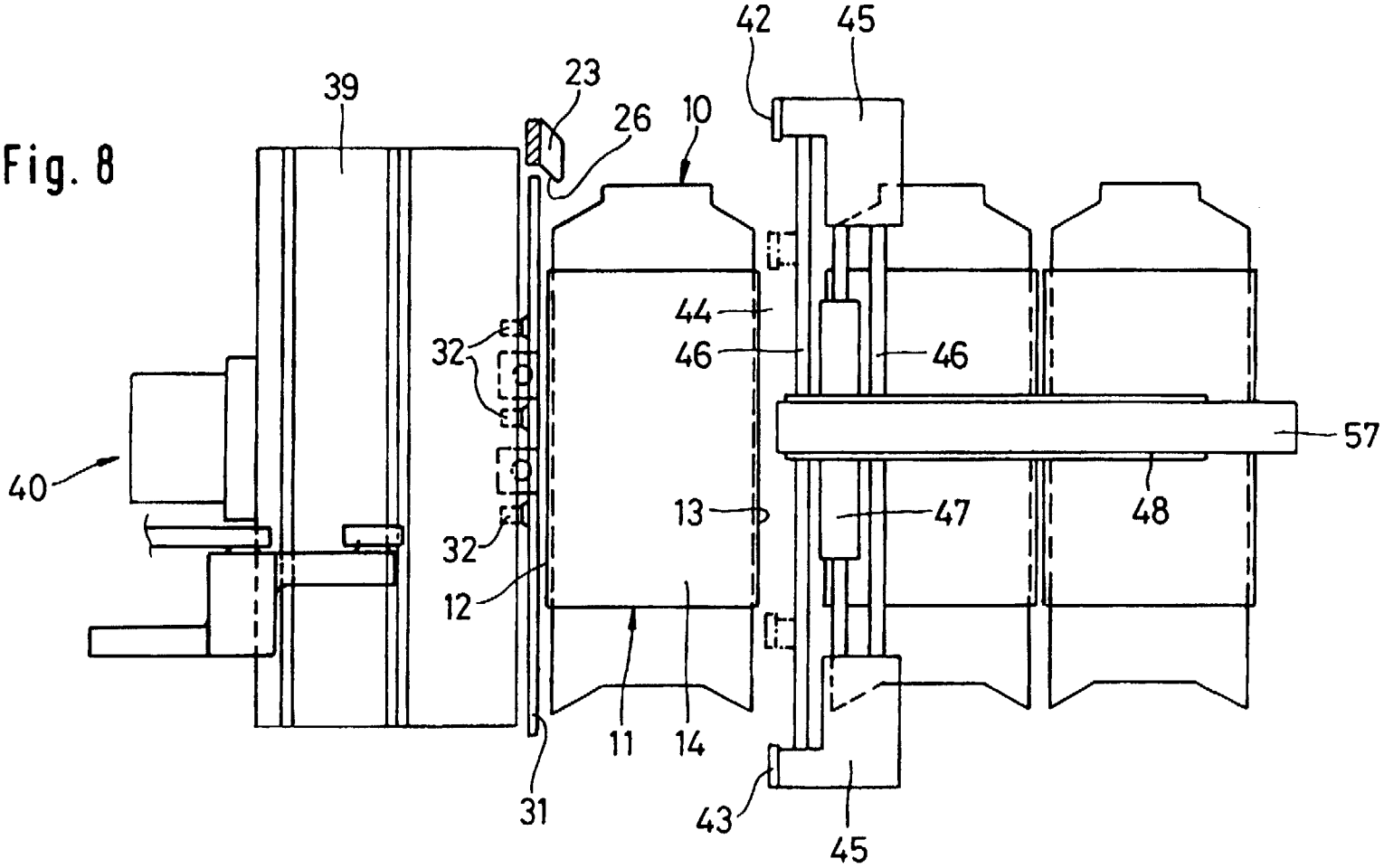
FIG. 8 shows a detail of the wrappings station in plan view.

The transfer of the stack 10 of blanks from the plate 21 to the vertical conveyor 40 is carried out by a pusher unit 41. In the present case, this comprises two upright driver rods 42, 43, which enter from a sideways position according to FIG. 8, outside the movement path of the stacks 10 of blanks, by means of an opposing transverse movement, into an interspace 44 formed between the stack 10 of blanks on the plate 21, on the one hand, and the stacks 10 of blanks on the feed conveyor 18, on the other hand. This interspace 44 has been produced by the fact that the feed conveyor 18, after the deposition 1 of the stack 10 of blanks on the plate 21 is driven in the opposite direction in such a way that a reverse conveying movement of the row 17 of the stacks 10 of blanks takes place. The driver rods 42, 43, which have entered into the interspace 44, support in an adapted manner the conveying movement of the stack 10 of blanks from the plate 21 onto the platform 39 during the downward movement of the wrapping 11.

The driver rods 42, 43 can be displaced with sliding pieces 45 on transversely directed rods 46. The transverse movement of the driver rods 42, 43 is effected by cylinder 47.

The pusher unit 41 which has been described in this respect is fitted to a linear cylinder 57, extending in the conveying direction, for carrying out the pushing movement. Said linear cylinder is positioned above the movement path of the stack 10 of blanks. The rods 46 are fitted to a support 48 which for its part is connected to a piston of the linear cylinder 57. By means of the latter, the driver rods 42, 43 can be moved in the pushing-down direction of the stack 10 of blanks, carrying the latter with them.

The driver rods 42, 43 become effective on the stack 10 of blanks outside the area of the wrapping 11. During the pushing-down movement, a side loop 38 is produced thereby by the lower transverse web 15 of the wrapping. The latter is pulled away completely downward, as soon as the stack of blanks is deposited on the discharge conveyor or on the platform 39 (FIG. 6).

To transport the severed wrapping 11 away completely in the downward direction, further drawing elements become effective. This is a pair of drawing rolls with a fixed, larger drawing roll 49 and a mating roll 50 which rotates simultaneously. The latter is fitted to the bearing wall 31, underneath the sucking element 32. The wrapping 11 or its limb 12, bears on the mating roll 50 after the severing. As a result of the lowering movement into the position according to FIG. 4, the mating roll 50 passes into a position opposite the drawing roll 49. As a result of the common effect of the pair of rolls 49/50, the wrapping 11 as a whole is conveyed downward.

The wrapping 11, finally completely pulled from the stack 10 of blanks, passes into a collecting container 51 underneath the plate 10.

Figure 6:
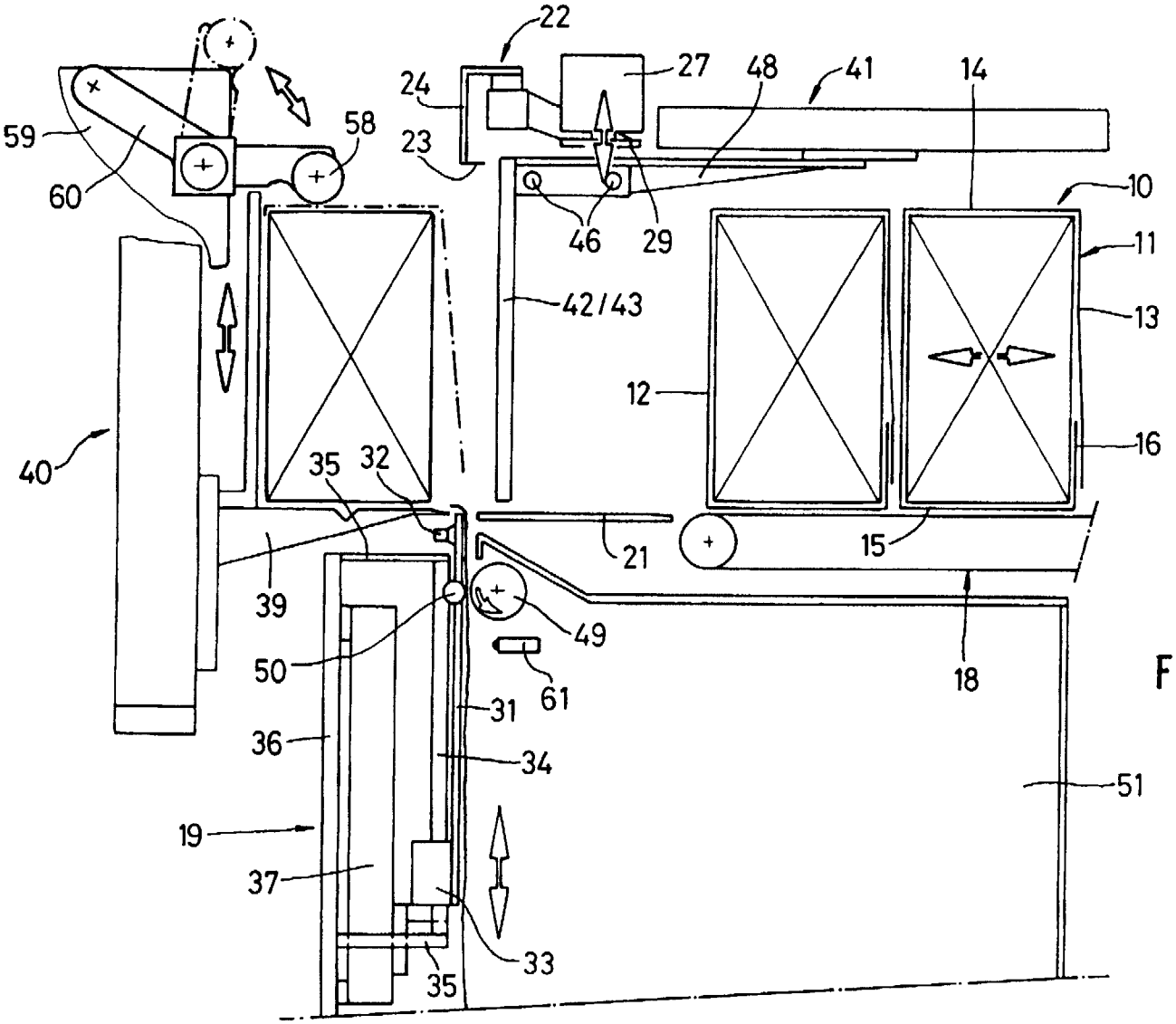
FIG. 6 shows a further changed representation similar to FIG. 3 to FIG. 5 during the pushing away of a stack of blanks onto a discharge conveyor.
Figure 7:
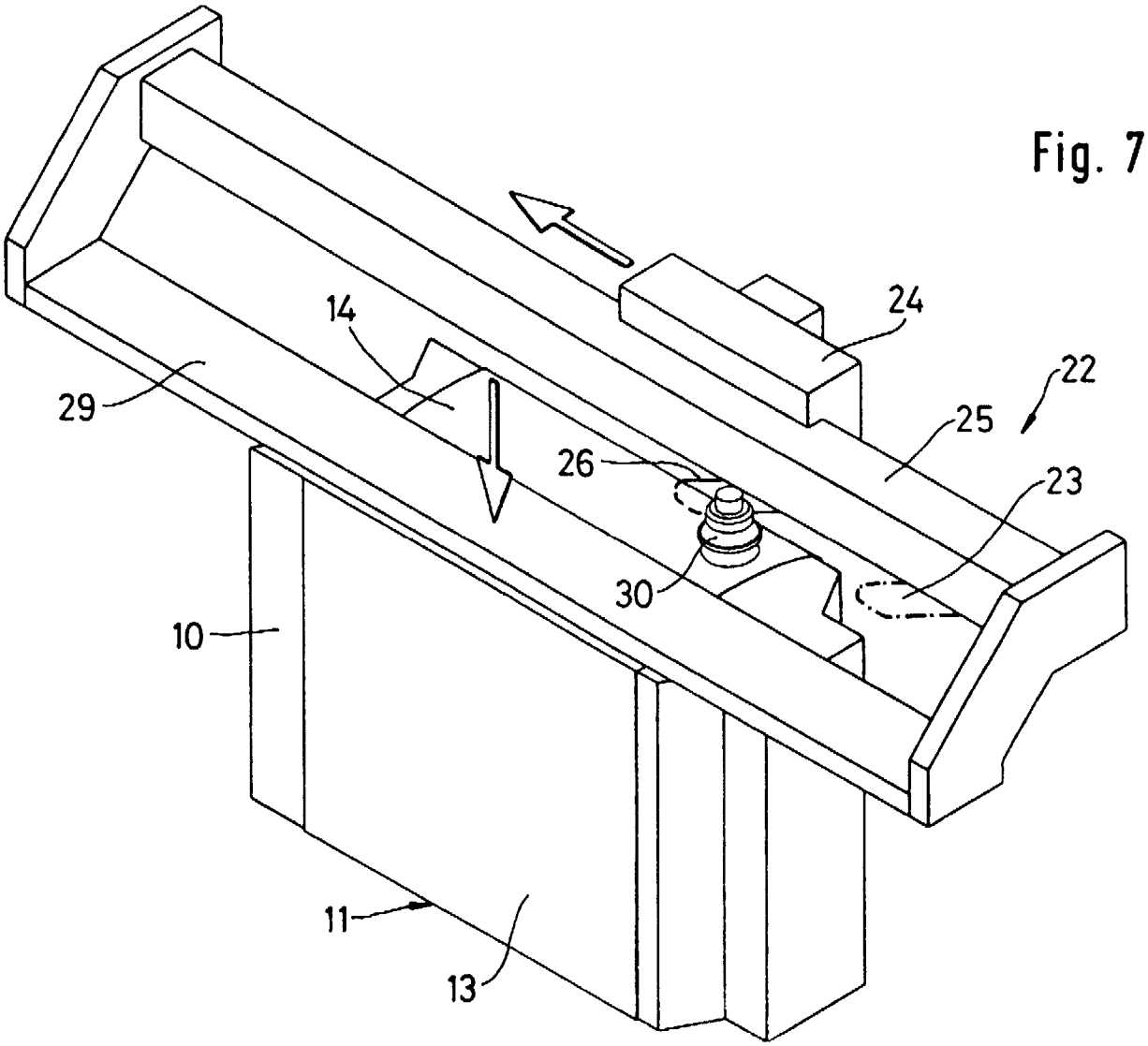
FIG. 7 shows a knife unit in a perspective, schematic representation.

In spite of the effect of the sucker 30, it cannot always be excluded that the upper transverse web 14, after the severing cut, falls back with the residual web 28 into the initial position (FIG. 6, dash-dotted line). During the complete drawing down of the wrapping 11, it must be ensured that upper blanks of the stack 10 of blanks are not drawn down simultaneously by the residual web 28. For this purpose, a holding element is assigned to the vertical conveyor 40, and exerts a restraining force on the stack 10 of blanks while the wrapping 11 is being drawn off. Said element is a pressure roller 58 which is lowered from above onto the stack 10 of blanks, in the present case in the area of the wrapping 11 or of the limb 12. The pressure roller 58 is supported in a mounting 59 and can be moved by a cylinder (not shown) into the pressure position (continuous lines in FIGS. 6 and 8). The pressure roller is in this case fitted to a pivotably supported, two-armed lever 60 on whose free end the hydraulic cylinder engages. The pressure roller 58 has the effect that the stack 10 of blanks is fixed in an unchanged position on the platform 39 while the wrapping 11 is being drawn off downward.

Only after the complete removal of the wrapping 11 is the stack 10 of blanks transported away by the vertical conveyor 40. For this purpose there is fitted underneath the wrappings station 19 a monitoring element, namely a light barrier 61. This releases the transporting away of the stack 10 of blanks when the wrapping 11 has moved completely past the light barrier 61.

The stacks 10 of blanks are fed by the vertical conveyor 40 to a linear conveyor 52 for further processing. Said linear conveyor transports the stacks 10 of blanks to an elevated level ("overhead") to the packaging machine 20. Here, the stacks 10 of blanks are transferred to blanks magazines 53.

The linear conveyor 52 comprises in the present case a horizontal conveyor track 54, on which stacks 10 of blanks rest. Lateral guides secure the stacks 10 of blanks in this position. A driver 55, which can be moved to and fro, seizes the stack 10 of blanks in each case at the rear and transports it in a sliding manner on the conveyor track 54. The driver 55 in driven by an elongated linear cylinder 56. The stacks 10 of blanks are pushed by the driver 55 away from the platform 39 of the vertical conveyor 40 and directly transferred to the conveyor track 54.

What is claimed is:

1. A process for transporting elongate stacks (10) of superimposed blanks and for severing and removing a wrapping, which centrally surrounds each stack (10), in a wrapping station (19) by a knife (23), the wrapping (11) being provided with a lower transverse web (15) which rests against a bottom side of the stack (10), an upper transverse web (14) which rests against a top side of the stack (10), a first upright limb (13) which rests against a first upright longitudinal side of the blank stack (10), and a second upright limb (12) which rests against an opposite second upright longitudinal side of the stack, said process comprising the following steps:

a) for severing the wrapping (11), moving the knife (23) and the stack (10) relative to one another in a horizontal plane;

b) during the relative movement, inserting the knife (23) laterally between upper ones of the blanks of the stack (10), and moving the knife (23) relative to the stack along the first and second longitudinal sides thereof, so that the second upright limb (12) is severed;

c) guiding the knife (23) relative to the stack (10) in such a way that the second upright limb (12) of the wrapping (11) is severed closely below the upper transverse web (14);

d) after the severing of the wrapping (11), downwardly drawing away a remainder of the second upright limb (12) which adjoins the lower transverse web (15); and e) then pushing off the blank stack (10) in the horizontal direction by applying pressure in a region of the stack side which is located opposite the second upright limb (12);

wherein the pushing off step comprises applying pressure to both sides of the stack which are adjacent to the first upright limb (13) so that the first upright limb (13) and the lower transverse web (15) form a side loop (38) which is pulled downwardly after the stack (10) has been pushed off.

2. An apparatus for transporting elongate stacks (10) of superimposed blanks and for severing and removing a wrapping, which centrally surrounds each stack (10), in a wrapping station (19) by a knife (23), the wrapping (11) being provided with a lower transverse web (15) which rests against a bottom side of the stack (10), an upper transverse web (14) which rests against a top side of the stack (10), a first upright limb (13) which rests against a first upright longitudinal side of the blank stack (10), and a second upright limb (12) which rests against an opposite second upright longitudinal side of the stack, said apparatus comprising:

a) a knife holder (24) from which the knife (23) projects on one side in a horizontal plane;

b) for severing the wrapping, means for moving the knife holder, with the knife (23), in a horizontal Plane relative to the blank stack (10) and along a plane of the second upright limb (12); and c) means for moving the knife (23) relative to the blank stack (10) at a certain height of the blank stack, so that the knife is inserted between upper ones of the blanks in a horizontal plane and severs the second upright limb (12) immediately below the upper transverse web (14);

and further comprising in the wrapping station:

an upright bearing wall (31), which is movable up and down in a vertical plane between an upper starting position and a lower position, and which is provided with holding members for grasping the second limb (12);

a plate (21) on which the blank stack (10), in the upper starting position of the bearing wall, rests, wherein the stack (10), during the severing of the wrapping (11), rests against the bearing wall (31) with a lower region of the second limb (12); and means for drawing the severed second limb (12) away downwards from the holding members of the bearing wall (31) when the bearing wall is moved into a lower position.

3. The apparatus as claimed in claim 2, further comprising a pair of drawing rollers including a fixed drawing roller (49) and a mating roller (50) arranged on the bearing wall (31).

4. The process as claimed in claim 1, further comprising feeding the blank stacks (10) to the wrapping station (19) transversely to their longitudinal direction and with the second upright limb (12) which is to be severed located in front.

5. The process as claimed in claim 1, wherein, after severing of the second upright limb (12), a lower part thereof is drawn away downwardly by a suction member (32) together with a stop for the blank stack (10).

6. The process as claimed in claim 1, wherein the second upright limb (12) of the wrapping (11) is severed below the upper blank, or only a few blanks below the knife (23).

7. The process as claimed in claim 1, wherein, during the severing of the wrapping (11), pressure is exerted on the blank stack from above, on a region which is on a top side of the blank stack (10) and which is located opposite the knife (23), such that a region of the upper transverse web (14) faces the knife (23) and is lifted slightly relative to the region which is subjected to pressure.

8. The process as claimed in claim 1, further comprising exerting a lifting force on a region of the upper transverse web (14), or on corresponding regions of the blank facing the knife (23), by sucking up the transverse web (14) and/or the upper blank.

9. The process as claimed in claim 1, wherein the blank stacks (10), before severing of the wrapping (11), are conveyed, with the second limb (12) ahead in a horizontal plane, up to an upright stop wall (31).

10. The apparatus as claimed in claim 1, further comprising, in the wrapping station (19), an upright bearing wall (31) against which the blank stack (10), resting on a plate (21), bears at least with a lower region of the second limb (12) when the wrapping (11) is severed.

11. The apparatus as claimed in claim 10, wherein the bearing wall (31) is movable up and down between an upper starting position and a lower position, wherein the suction member (22) forms part of the bearing wall (31), such that the lower part of the severed second limb (12) is drawn away downwards into the lower position when the bearing wall (31) is moved, and wherein the blank stack (10) bears against the bearing wall (31) located in an upper position, at least with a lower region of the second limb (12), when severing the wrapping (12).

12. The apparatus as claimed in claim 2, wherein the knife (23) is movable in a horizontal plane for carrying out the severing cut in the region of the second upright limb (12) of the wrapping (11) while the blank stack (10) is resting on the plate (21) of the wrapping station (19).

13. The apparatus as claimed in claim 2, further comprising a pressure member, in the wrapping station (19), which eccentrically exerts pressure on a top side of the blank stack (10) in a region facing away from the second limb (12) to be severed.

14. The apparatus as claimed in claim 2, further comprising a sucker (30), in the wrapping station (19), which eccentrically acts upon the top side of the blank stack (10) or the upper transverse web (14) in a region facing the second limb (12) to be severed, for lifting the upper blank or the transverse web (14).

15. The apparatus as claimed in claim 1, wherein said pusher unit (41) comprises two upright driver rods (42, 43) which are movable in a sideways movement into the movement path of the blank stack (10), are movable out of said movement path, and are movable in the conveying direction of the blank stack (10).

16. An apparatus for transporting elongate stacks (10) of superimposed blanks and for severing and removing a wrapping, which centrally surrounds each stack (10) around elongate sides thereof, in a wrapping station (19) by a knife (23), the wrapping (11) being provided with a lower transverse web (15) which rests against a bottom side of the stack (10), an upper transverse web (14) which rests against a top side of the stack (10), a first upright limb (13) which rests against a first upright longitudinal side of the stack (10), and a second upright limb (12) which rests against an opposite second upright longitudinal side of the stack, said apparatus comprising:

a) a conveyor (18) successively transporting the stacks in a conveying direction (10) transversely to their longitudinal dimension;

b) a plate (21);

c) means for depositing onto said plate (21) each stack (10) which comes from said conveyor and which is in front in the conveying direction;

d) means for causing the knife (23) to sever the wrapping (11) of the stack (10) deposited on said plate (21);

e) for severing the wrapping (11), means for moving the knife (23) relative to the stack (10) along the plane of the second upright limb (12), which is located in front in the conveying direction, and in an upper region of the second upright limb (12), so that the knife severs the wrapper in an upper region thereof which is closer to the upper transverse web (14) than to the lower transverse web (15);

f) a movable up and down suction member (32) for grasping the lower, severed part of the second upright limb (12);

g) for drawing away the lower severed part of the second upright limb (12), means for moving the suction member (32) downwards, from a position in front of the stack (10) and above the plate (21), together with the lower part of the second upright limb (12), to below the plane of the plate (21);

h) a pusher unit (41) for pushing the stack (10) off the plate (21), in extension of the conveying direction, onto a platform (39) of a discharge conveyor; and i) activatable means (49, 50), located below the plate, for completely downwardly pulling away the wrapping (11), said activatable means being activated during the pushing off of the stack (10) from the plate (21).

17. The apparatus as claimed in claim 16, wherein said activatable means comprises a pair of drawing rollers (50, 49) which is activated as soon as the suction member (32), with the lower part of the second upright limb (12), is moved to below the plane of the plate (21) and the lower part of the second upright limb (12) is moved between the drawing rollers (50, 49).

* * * * *